US005947383A

United States Patent [19]

Faustmann

[11] Patent Number: 5,947,383

[45] Date of Patent: Sep. 7, 1999

[54] LINEAR GAS BURNER

[76] Inventor: Heinz Faustmann, An der Heilquelle 29, D-63773 Goldbach, Germany

[21] Appl. No.: 09/070,388

[22] Filed: Apr. 30, 1998

[30] Foreign Application Priority Data

May 20, 1997 [DE] Germany ..... 19718532

[51] Int. Cl.[6] ..... B05B 15/00

[52] U.S. Cl. ..... 239/132.3; 239/555.3; 239/556

[58] Field of Search ..... 239/132.3, 553.3, 239/553.5, 590.3, 590.5, 563, 556, 557, 600, 596

[56] References Cited

U.S. PATENT DOCUMENTS

| | | | |
|---|---|---|---|
| 1,379,301 | 5/1921 | Hamilton | 239/556 |
| 3,715,183 | 2/1973 | Manifold | 239/553.3 |
| 3,736,095 | 5/1973 | Leatherby | 239/553.3 |

*Primary Examiner*—Andres Kashnikow
*Assistant Examiner*—Dinh Q Nguyen
*Attorney, Agent, or Firm*—Fulbright & Jaworski, LLP

[57] ABSTRACT

A linear gas burner for the heat treatment of webs of material has at least one feed line for fuel gas and a long, hollow body, in one of the long sides of which a series of burner nozzles is provided. To equalize the length of the flames and to avoid useless excess lengths or burner at the two sides of the material webs, the hollow body is divided in its longitudinal direction by a baffle into a low-pressure space and a high-pressure space, into which the feed line for the fuel gas opens. The baffle has openings for the passage of the fuel gas, which flows into the low-pressures space in front of the burner nozzles. To simplify production and to reduce production and assembly costs, the hollow body consists of a continuous, extruded metal profile with an essentially U-shaped cross section with a yoke part and two sidepieces, between the free ends of which at least one nozzle plate with two long edges and the burner nozzles is inserted, the sidepieces being clamped by tension rods against the nozzle plate or plates. Preferably, a hole structure for the further equalization of the flow is provided between the baffle and the burner nozzles.

11 Claims, 3 Drawing Sheets

LINEAR GAS BURNER

BACKGROUND OF THE INVENTION

The invention pertains to a linear gas burner for the heat treatment of webs of material, especially for machines for flame lamination, with an elongated hollow body, closed at both ends, which has a feed line for fuel gas and a series of burner nozzles in one of its long sides, this hollow body being subdivided in the longitudinal direction by a baffle into a low-pressure space and a high-pressure space, into which at least one feed line for the fuel gas opens, the baffle for the fuel gas being provided with openings, which lead to the low-pressure space located between the baffle and the burner nozzles.

U.S. Pat. No. 366,780 describes a rectangular design, which consists of three parts, namely, a nearly flat base plate with a gas connection in the middle; a baffle in the form of an inverted pan with an arc-shaped, upward-curving yoke and two flat sidepieces in the form of segments of a circle, which diverge in the transverse direction as they extend downward; and a 3-dimensional nozzle body arranged above for producing the flame, which has approximately the form of half a hollow cylinder, closed at the ends, the entire extent of which is provided with burner nozzles in the surface of the half-cylinder. The nozzles are oriented in the radial direction, from which the flames also emerge in the radial direction. In a burner of this type, parts of different length must be fabricated for each different length of burner. This increases the cost of production.

In addition, the flames spread out widely, in all directions, which means that it is impossible to generate a directional effect, that is, to produce parallel flames with a strictly linear energy concentration. The heating of webs of material is not mentioned. When used for such a purpose, the wide energy distribution would lead to considerable energy losses and thus to poor efficiency; in addition, the area surrounding the burner would be heated up significantly, as a result of which the personnel operating the machine would be subjected to considerable stress. A burner of this type is not designed for heating in a linear fashion in its longitudinal direction and is thus neither intended nor suitable for heating a continuously traveling web of material uniformly across its width. Burners of this type are used primarily in cooking ovens, to heat rooms, and in open grate fireplaces.

DE 19 91 513 U describes a round burner for the combustion of gas-air feed mixtures, in which one or more perforated disks with holes offset with respect to each other and the burner nozzles are provided between a gas inlet and a nozzle plate. As a result, expansion and mixing chambers for the mixture are formed, and also the gas velocity is reduced. Although the round burner, in contrast to U.S. Pat. No. 366,780, has a strong directional effect, it is precisely for this reason that, because of its focused effect, it is unsuitable for uniformly heating wide, continuously traveling webs of material, nor is it intended for this purpose. It would merely produce strip-like burns in the traveling webs.

DE 39 16 142 A1 describes a linear or bar burner intended to heat sectional boilers for water heating, to which a gas-primary air mixture is supplied and to which, to reduce the formation of nitrous oxide, cooled secondary air is supplied to an area above the bases of the flames. A flat or curved burner plate is used. The secondary air guides are hollow, and cooling water flows through them; thus the secondary air is conducted across the outer surface of the secondary air guides by corresponding profiling to the core of the flame. In a preferred embodiment, the bar burner is arranged inside a trough, the side walls of which are provided with coolant channels parallel to the bar. The burner plate, however, is not preceded by any baffles or perforated structures for equalizing the flow and mixing the gas. The individual parts of the burner, including the nozzle plate, should preferably be made of profiled sheet steel, these sheet metal parts being welded together along their longitudinal edges. The possibility of the linear heating of traveling webs of material is not discussed.

Linear burners for the flame lamination of traveling webs of material are described in the prospectus for flame lamination machines of Schmitt-Maschinen. The hollow, elongated body is assembled from individual castings with graduated lengths of 20–40 cm. The butt joints between them, where the seals are located, must be machined, and the individual castings are screwed together in each case by four screws. The nuts or cap nuts are housed in pocket-like recesses, which constrict the inside cross section of the hollow body. Not only is it an extremely complicated matter to produce such burners, but the known linear burners also tend to become distorted under the effect of nonuniform temperature stresses.

It is also known that the hollow bodies of linear burners of this type can be assembled from two extruded half-shells, which, after assembly, have the form of a "U" in cross section. Seals and a row of screws are required at the joints between the shells, which again leads to the distortion of the linear burner or to deflection because linear burners of this type are subjected to the heat of the flame on only one side. It must be remembered that linear burners of this type can easily be anywhere from 2 to 4 meters long.

Common to all the known linear burners for flame lamination is that they do not have any effective devices in their interior by means of which the energy distribution of the flames in the longitudinal direction of the linear burner can be improved to a sufficient degree. As a rule, linear burners of this type are connected at both ends to fuel gas lines, through which a stoichiometric mixture of a gaseous hydrocarbon and an oxidation gas such as air is supplied. Because of the linear momentum of the flow of fuel gas, the pattern of the flame in the longitudinal direction of the linear burner is characterized by the absence of any flame at all at the two ends over a distance of about 15–25 cm. In the middle of the linear burner, furthermore, where the flows of gas from the two ends collide, the intensity of the flame produced is intensified. Although this is difficult to see from the length of the flame, it is very easy to verify on the basis of the end product.

Linear burners of this type are used for the flame lamination of webs of material. "Flame lamination" is a method for producing a composite of two or three material components (either single or sandwich lamination) on a calendering machine by exploiting the adhesive properties of foam when it is treated by the flame of a linear burner. Flame-laminating machines are used to bond thermoplastic materials such as foam sheets of polyester, polyether, or polyethylene or some other type of adhesive sheet to textiles, PVC sheets, artificial leather, nonwovens, papers, or other materials to produce, for example, covering materials for motor vehicle seats, articles of clothing, etc. A linear burner set up over the entire working width melts the surface of the foam sheet, as a result of which an adhesive film is formed. In the calender the foam sheet and the upper or lower layer are bonded together as they pass through a roll gap, a process which can be referred to as "bonding". The working speeds in this case depend on the material and can be as high as 60 m per minute.

The above-described nonuniform distribution of the burner energy now has the result that the terminal sections of the linear burner, which are about 15–25 cm long, are useless for the flame lamination process. As a result, the burners and thus the machine stand must be made longer than they would other wise have to be, which leads to a considerable increase in cost. But even so, the disadvantage remains that the greater flame intensity in the middle of the linear burner cannot be equalized. Considerable problems are therefore encountered in the regulation of the linear burner. The tolerance range within which the energy input can be adjusted is thus significantly restricted.

Against this background, the task of the invention is to improve a burner of the general type indicated above in such a way that it can be produced in virtually any length without having to arrange housing components next to each other in a row; is easy to install; and ensures a very uniform energy distribution over its entire length for the uniform heating of wide, traveling, temperature-sensitive webs of material, so that there is no longer any need to make the burner longer than it would otherwise have to be to accommodate the areas free of flame or with reduced heating output at the ends and so that the intensity peaks in the middle of the linear burner are avoided.

SUMMARY OF THE INVENTION

The task thus defined is accomplished according to the invention in a linear burner of the type described above in that:

(a) the hollow body consists of a continuous, extruded metal profile with an essentially U-shaped cross section, with a yoke part and two sidepieces, into free ends of which at least one nozzle plate with two longitudinal edges and a quasi-homogeneous distribution of burner nozzles is inserted; and (b) the sidepieces are clamped by tension rods against the longitudinal edges of the nozzle plate(s).

As a result of this design and production approach, it becomes much easier and cheaper to build the known and very long linear burner for the flame lamination of wide, traveling webs of material, especially under consideration of the fact that such a linear burner is provided over its entire length with a built-in baffle for equalizing the gas flow and the length of the flame, which has been unknown up to now. This baffle creates a low-pressure space upstream of the nozzle plates.

The term "high-pressure space" does not mean that the pressures are very high; linear burners of this type are usually operated at gas pressures of 10–100 mm $H_2O$ above atmospheric pressure. The term "low-pressure space" means that the pressure which prevails there is between the pressure in the high-pressure chamber and atmospheric pressure and is on such a level that the gas velocities produced in the burner nozzles are greater than the rate of flame propagation of the gas-air mixture.

The result achieved by the baffle is that, on its high-pressure side, the gas pressure is equalized; this leads to the uniform throughput of the fuel gas through the openings across the entire length of the linear burner. As a result, the problems of the formation of flameless zones at the two ends of the linear burner and of the occurrence of energy peaks in the middle of the linear burner, which could lead to the thermal overload of the web of material, are avoided. Instead, an extremely homogeneous flame pattern is achieved over the entire length of the linear burner. Thus, for given widths of the material webs, much shorter linear burners and machine stands can be used, and the adjustment or automatic control of the burner energy is made much easier, because there is no longer any need to take energy peaks into account. The machine stand usually specifies the length of the linear burner.

It is especially advantageous to provide an array of holes between the baffle and the burner nozzles to achieve an additional equalization of the flow. This hole structure can consist of a perforated plate a wire screen, a wire fabric, or a metal nonwoven material.

It is especially advantageous, however, for the hole structure to consist of a perforated plate, bent down along two bending edges, with a yoke part and two sidepieces, the free, long edges of the sidepieces being supported on the baffle, between the openings, whereas the bending edges are supported on two shoulders of the hollow body.

This creates a flow pattern in which the fuel gas first flows through the openings in the baffle, then through the perforated sidepieces, and finally through the perforated yoke part to the burner nozzles. As a result, vortices in the flow are almost completely eliminated, and the fuel gas or gas mixture flows in the manner of a plug flow to the burner nozzles. As a result, an extremely high degree of flame stability is achieved.

As a result of the hole structure, it is as if a two-stage pressure reduction was achieved between the high-pressure space and the burner nozzles, in that the low-pressure space is again subdivided into two spaces with graduated pressures.

The hollow body consists of a continuous, extruded metal profile with an essentially U-shaped cross section; it has a yoke part and two sidepieces, into the free ends of which a nozzle plate with two long edges and a quasi-homogeneous distribution of the burner nozzles is inserted, and then the sidepieces are clamped against the long edges of the nozzle plate by tension rods.

As a result of this design according to the invention, it becomes extremely easy to install and mount the nozzle plate and the baffle, which are clamped between the free ends of the sidepieces of the hollow body as if between the jaws of a pliers.

It is also advantageous for the hollow body to have an inside profile with two longitudinal recesses for the insertion and fixation of the baffle. It is especially advantageous for this baffle to consist of a flat piece of metal with projections at certain intervals, which engage in the longitudinal recesses in the hollow body, the spaces between them forming the openings for passage of the fuel gas. As an alternative, it is also possible, of course, to provide holes in a quasi-homogeneous distribution in a baffle made of flat material.

The relationships between the holes or openings both in the baffle and in the hole structure will be selected in accordance with the desired pressure graduation; it is advisable for each of the individual elements to be responsible for half of the pressure difference between the pressure in the high-pressure space and the required pressure directly in front of the burner nozzles.

Additional advantageous embodiments of the object of the invention will be apparent to those skilled in the art.

An exemplary embodiment of the object of the invention and its use in a flame-lamination system are explained in greater detail below on the basis of FIGS. 1–3.

DETAILED DESCRIPTION

Figure 1:
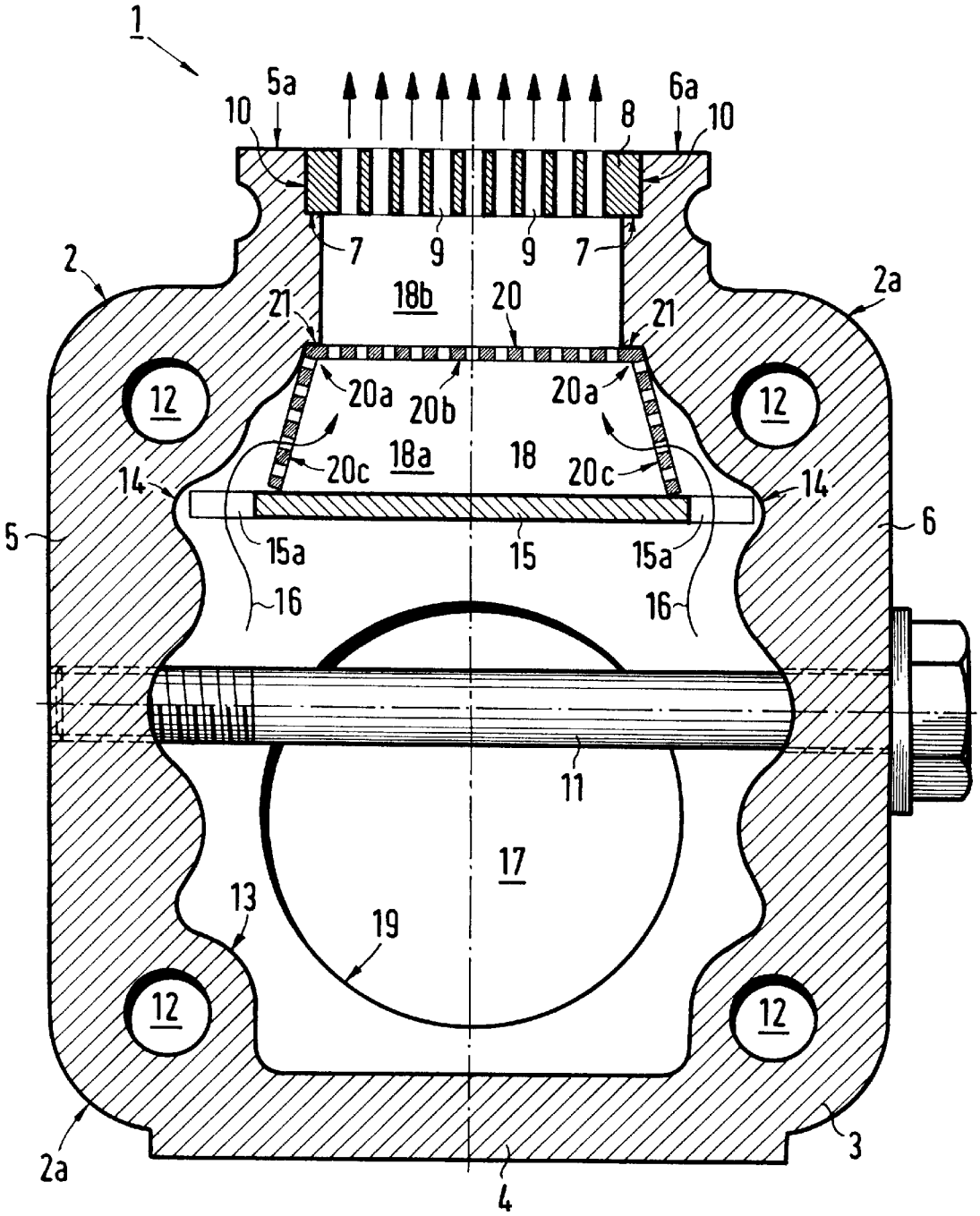
FIG. 1 is a cross section through a linear burner.

FIG. 1 shows a linear burner 1, the supporting part of which is a hollow body 2, which consists of a U-shaped, extruded metal profile 3, which has a yoke part 4 and two sidepieces 5, 6 Sidepieces 5, 6 extend inward at their two free ends 5*a*, 6*a*, and, on their inside surfaces, have shoulders 7, on which a series of rectangular nozzle plates 8, each with a very large number of closely spaced burner nozzles 9, rest. Nozzle plate 8 has two parallel side edges 10, against which sidepieces 5, 6 are pressed by several tension rods 11, only one of which is visible. Nozzle plate 8 can also be designed as a single piece. The axes of all burner nozzles 9 are parallel to each other, which greatly simplifies production, reduces production costs, and improves the directional effect of the flame front.

In cross section, hollow body 2 has an approximately rectangular outline with four well-rounded longitudinal edges 2*a*. Four coolant channels 12 are provided in the area of these longitudinal edges.

Hollow body 2 has an inside profile 13 with two longitudinal recesses 14, into which a baffle 15 is placed by sliding the baffle in the longitudinal direction. The baffle 15 consists of a flat piece of metal with projections 15*a*, arranged at intervals in the longitudinal direction of the hollow body; these projections engage in longitudinal recesses 14 in hollow body 2 and form between them the openings for passage of the fuel gas, as indicated by the two arrows 16. The baffle 15 extends over the entire length of hollow body 2, but it can also be assembled from individual sections. It is not necessary for projections 15 to form a single unit with the baffle; it is also possible to weld them on in the form of narrow strips.

Figure 2:
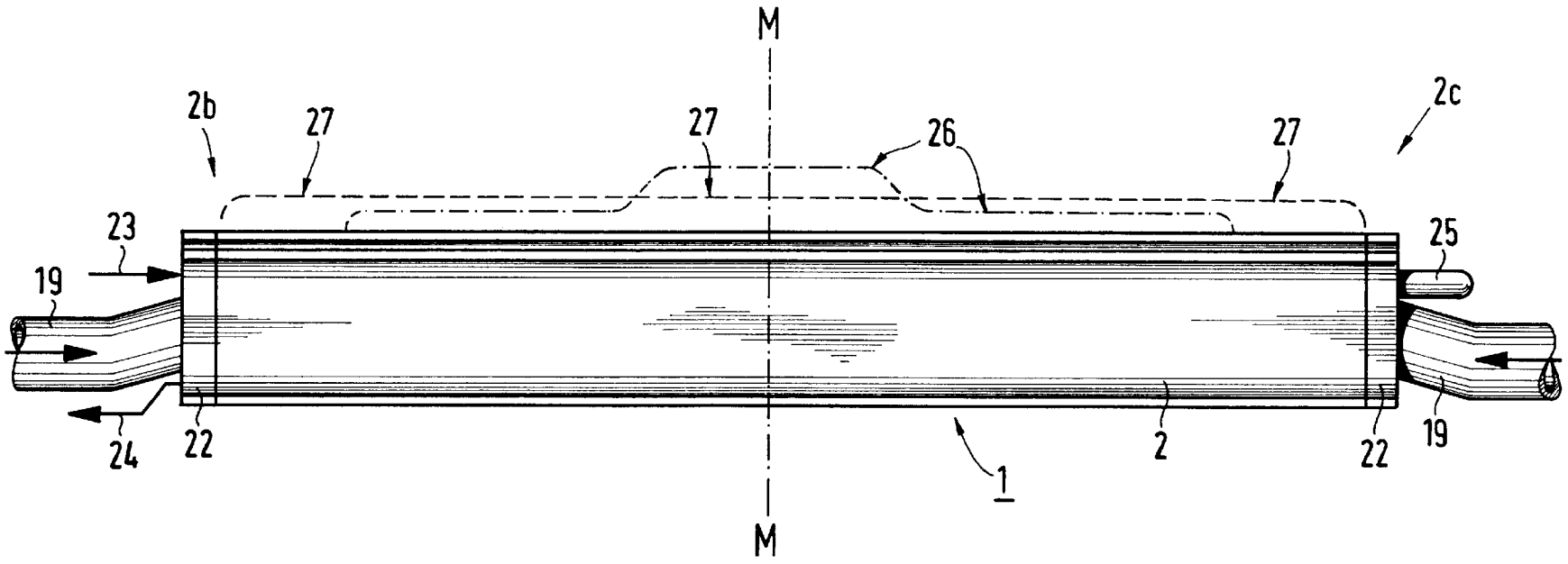
FIG. 2 is a side view of the object according to FIG. 1 on a highly reduced scale.

As a result of baffle 15, the interior space of hollow body 2 is divided into a high-pressure space 17 and a low-pressure space 18. As shown in FIG. 2, feed lines 19 for the fuel gas or fuel gas mixture lead into high-pressure space 17 at both ends. For burners which are not too long, it is also possible to provide only a single feed line for the fuel gas, which then is flanged on halfway along the length of hollow body 2.

Between baffle 15 and burner nozzles 9 there is a hole structure 20, which divides low-pressure space 18 into two smaller spaces 18*a*, 18*b*. This hole structure 20 consists of a perforated plate, bent down along two bending edges 20*a*, with a yoke part 20*b* and two sidepieces 20*c*, the free, long edges of which are supported on baffle 15 between the openings according to arrows 16. Bending edges 20*a* are supported for their part on two shoulders 21 of hollow body 2. Thus the flow pattern indicated by arrows 16 is achieved. First, the fuel gas flows through the openings in baffle 15, then through perforated sidepieces 20*c*, and finally through yoke part 20*b* to burner nozzles 9. As a result of the selected arrangement shown almost to scale in FIG. 1, the fuel gas passes through two different areas of hole structure 20, namely, through the sidepieces and also through the yoke part, as a result of which a complete mixing of the gas and finally, in partial space 18*b*, a practically laminar gas flow is produced, which creates ideal conditions for the uniform supply of burner nozzles 9 with fuel gas.

FIG. 2 shows how the object of the invention works in comparison with the state of the art. Hollow body 2 is sealed off at both ends 2*b*, 2*c* by end plates 22, into which feed lines 19 for the fuel gas are welded. The gas mixing devices and the connecting lines situated outside the drawing and the required automatic control devices have been omitted for the sake of simplicity. Arrows 23, 24 shown the entry and exit of the cooling water; a U-shaped pipe elbow 25 establishes a transverse connection and a series circuit. The cooling water is always supplied in such a way that the cold water flows first through coolant channel 12 in the uppermost position. This uppermost position is determined by the angle at which the burner is installed, as indicated in FIG. 3.

Dashed line 26 on different levels shows the change in intensity of a linear burner according to the state of the art. Here, in the area of the two ends 2*b*, 2*c*, no flame at all forms even at a considerable distance away from these two ends. Conversely, as a result of the collision between the two flow fronts, a flame of much greater intensity is created in the area of central plane M—M, which naturally also leads to a greater temperature load on the web of material.

As a result of the internal fittings according to the invention installed in hollow body 2 according to FIG. 1, the flame front and therefore the intensity distribution shown by straight dashed line 27 are now achieved. The relationships are somewhat exaggerated for the sake of illustration. What is produced, therefore, is a long flame front with an extremely homogeneous energy distribution in conjunction with a narrow width and good directional effect on the material to be heated. Energy losses as a result of lateral flames and excessive heating of the environment are eliminated almost completely.

Figure 3:
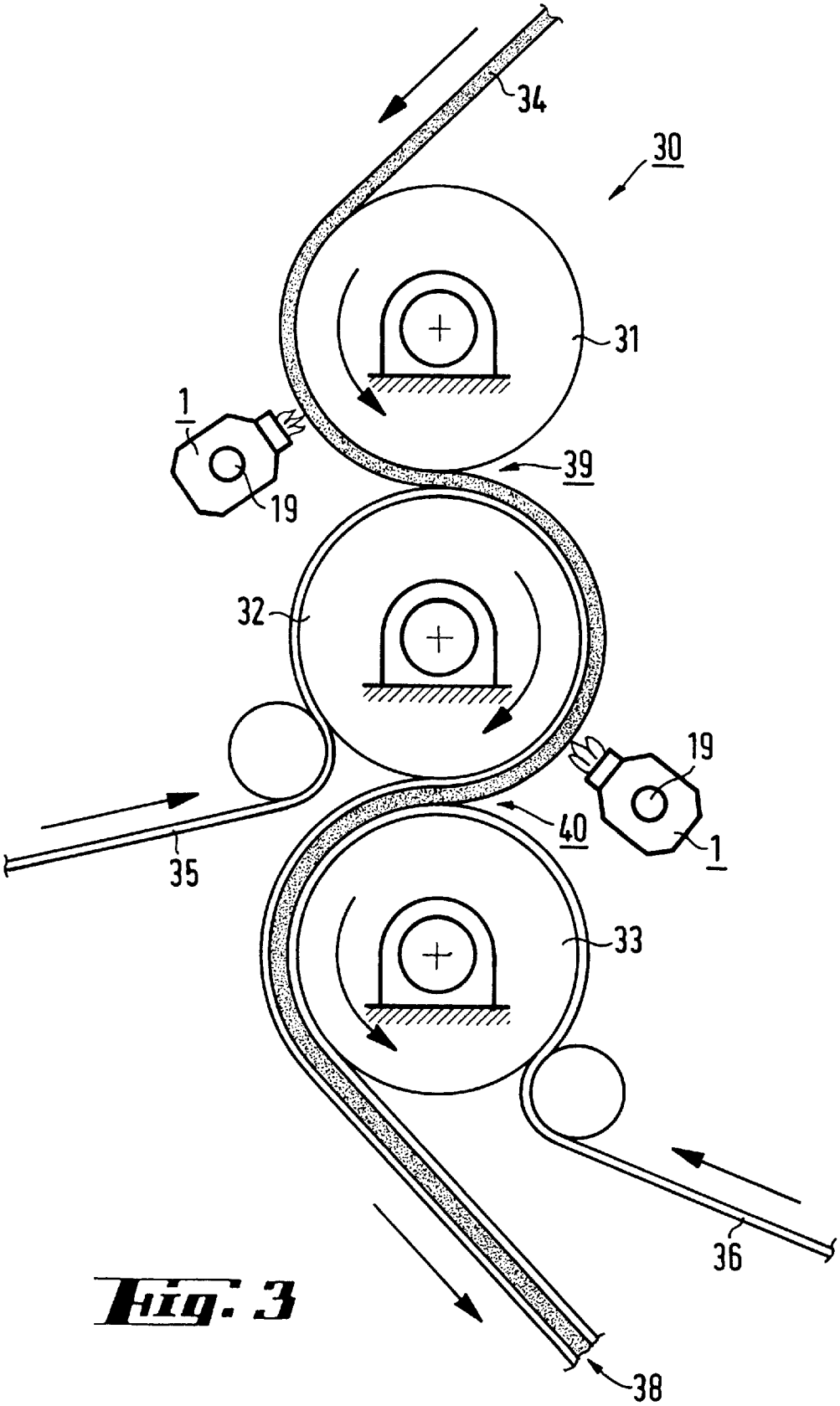
FIG. 3 is a side view of a system for flame-laminating three webs of material according to the sandwich principle.

FIG. 3 shows the essential elements of a flame lamination machine 30 with three calendering rolls 31, 32, 33. Flame lamination machine 30 is supplied with three webs of material 34, 35, 36, from which a so-called compound web 38 is produced. Web 34 in the middle is a web of foam, the surface of which can be brought into an adhesive state by two linear burners 1. In and of itself, however, this technology is state of the art, for which reason no attempt will be made to describe FIG. 3 in further detail. It can be derived from the figure, however, that the flame fronts of linear burners 1 bring the surfaces of foam of web 34 into an adhesive state immediately before they enter the immediately following roll gaps 39, 40. This means that an extremely uniform energy distribution over the length of linear burner 1 is required.

I claim:

1. A linear gas burner for the heat treatment of webs of material the burner comprising of a long, hollow body, closed at both ends, with at least one feed line for fuel gas and a series of burner nozzles in one of its long sides, the hollow body being divided in the longitudinal direction by a baffle into a low-pressure space and a high-pressure space, into which the feed line or lines for the fuel gas lead, and where the baffle has openings for the passage of the fuel gas, which lead to the low-pressure space located between the baffle and the burner nozzles, wherein (a) the hollow body consists of a continuous, extruded metal profile with an essentially U-shaped cross section with a yoke part and two sidepieces, into the free ends of which at least one nozzle plate with two long edges and a quasi-homogeneous distribution of the burner nozzles is inserted; and (b) the sidepieces are clamped by tension rods against the long edges of the nozzle plate(s).

2. The linear burner of claim 1, wherein the nozzle plates are designed to be at least essentially flat, and in that the axes of the nozzles are at least essentially parallel to each other.

3. The linear burner of claim 1, wherein the hollow body has an internal profile, which has two longitudinal recesses for the insertion and fixation of the baffle.

4. The linear burner of claim 3, wherein the baffle comprises a flat piece of metal with projections at intervals, which engage in the longitudinal recesses of the hollow body, the spaces between them forming the openings for the passage of the fuel gas.

5. The linear burner of claim 4, wherein the free ends of said sidepieces of said hollow body have two shoulders to support said nozzle plate.

6. The linear burner of claim 1, wherein a series of nozzle plates is inserted between the free ends of the sidepieces of the hollow body.

7. The linear burner of claim 1, wherein the hollow body has an approximately rectangular outline in cross section with four long edges and wherein four coolant channels are provided in the areas of these long edges.

8. The linear burner of claim 7, wherein the coolant channels are connected in series by a U-shaped pipe elbow.

9. The linear burner of claim 8, wherein said coolant line is positioned in such a way that the cold coolant flows first through said coolant channel in the uppermost position.

10. The linear burner of claim 1, wherein a hole structure for further equalization of the flow is provided between said baffle and said burner nozzles.

11. The linear burner of claim 10, wherein the hole structure comprises a perforated plate bent down along two bending edges, with a yoke part and two sidepieces, the free, long edges of the sidepieces being supported on the baffle between the openings, whereas the bending edges are supported on two shoulders of the hollow body, so that the fuel gas flows first through the openings in the baffle, then through the perforated sidepieces, and finally through the perforated yoke part to the burner nozzles.

* * * * *